US005101752A

United States Patent [19]

Smollar et al.

[11] Patent Number: 5,101,752

[45] Date of Patent: Apr. 7, 1992

[54] BODY BOARD

[75] Inventors: Marvin Smollar, Northbrook; Edward Watrobka, Sauk Village, both of Ill.

[73] Assignee: Marchon, Inc., Vernon Hills, Ill.

[21] Appl. No.: 651,195

[22] Filed: Feb. 6, 1991

[51] Int. Cl.[5] ..... B63B 7/00

[52] U.S. Cl. ..... 114/345; 441/65; 441/66

[58] Field of Search ..... 441/65, 35, 66, 40, 441/74, 44, 129, 130; 114/345; D21/228

[56] References Cited

U.S. PATENT DOCUMENTS

| | | | |
|---|---|---|---|
| D. 300,841 | 4/1989 | Minurri | D21/228 |
| 2,986,751 | 6/1961 | Baren | 441/66 |
| 3,056,979 | 10/1962 | Holladay | 441/66 |
| 3,455,571 | 7/1969 | Dallera et al. | 441/66 X |

*Primary Examiner*—Edwin L. Swinehart

*Attorney, Agent, or Firm*—Laff, Whitesel, Conte & Saret

[57] ABSTRACT

A body board for a water slide having an ergonometric design that conforms to the contours of a user's body having a generally frustoconical perimeter that circumscribes at least two chambers that are connected for pivoting movement with respect to one another.

13 Claims, 1 Drawing Sheet

BODY BOARD

FIELD OF THE INVENTION

This invention relates to body boards for water slides, and especially, but not exclusively, for slides that are placed on the ground and become lubricious when covered with a thin layer of water. More particularly, this invention relates to body boards with an ergonometric design that may be used on water slides and which absorb and cushion the user's body.

BACKGROUND OF THE INVENTION

Water slide toys for use at home are commonly known in the prior art. Existing water slides typically use an elongate sheet of flexible material, such as plastic, laid on the ground and covered with a thin layer of water to decrease friction in order to enable people to slide across the material. There are various means for attaching the slide sheet to the ground and for supplying a more or less constant layer of water onto the upper surface of the sheet.

It has been found that to enhance the play value of such water slide toys, a body board can be used to ride on and cushion the body of a person landing on and sliding down the elongate slide sheet. A body board not only can provide a cushioning effect to make the ride more comfortable, but can also enhance the excitement of the ride.

Prior art body boards for the type of water slides discussed here were originally adapted from body boards (sometimes referred to as "boogie boards") and surfboards used for surfing or otherwise riding on the ocean. Because such ocean boards are designed for use on a large body of water, it is unnecessary for the boards to include padding since the ocean water yields to the weight of the user and effectively creates a natural cushion. Consequently, ocean surfboards and body boards are not particularly suitable for adaptation for use on land-based water slides. If a modified ocean board is used on a water slide, even if the board is an air inflated version, it provides limited improvement.

At least some of the prior art water slide body boards were flat and rigid and were made from hard materials, such as compressed foam, for example, somewhat as ocean boards are made. However, as discussed, the rigidity and hardness of these body boards offer limited comfort to the user on a water slide. Moreover, such prior art body boards are cumbersome and the user's body tends to slide laterally off the hard board.

Consequently, air-inflated body boards were developed to eliminate these and similar problems. These prior art air-inflated body boards tended to merely follow the designs used in ocean boards, which are generally inadequate to provide sufficient cushioning for the user's body. Furthermore, prior art air-inflated body boards do not prevent a user's body from sliding laterally off the board. In addition, prior art body boards were generally of uniform width and, therefore, were cumbersome to use and interfered with the user's leg movement.

Accordingly, an object of the present invention is to provide water slide body boards that have an ergonometric design which cushions the user's body during use on a land-based water slide.

Yet another object of the present invention is to provide water slide body boards that have a design which tends to prevent the user's body from laterally sliding off the body board.

Another object of the present invention is to provide water slide body boards that have a design which tends to prevent the user's body from sliding forward off the body board.

A further object of the present invention is to provide water slide body boards that are not cumbersome to use and do not interfere with the user's leg movements.

Yet another object of the present invention is to provide a body board for a water slide that is relatively inexpensive to manufacture.

SUMMARY OF THE INVENTION

A preferred embodiment of the present invention includes a structure that accomplishes the foregoing objects by providing an inflatable body board having a generally elongated frusto-triangular shape that includes a plurality of chambers. One of the largest of the chambers is a bulging, pillow-like and convex expanded chamber which is generally centrally located towards the head of the board and which extends transversely across the width of the body board. In use this bulging chamber rotates upwardly toward the user in order to elevate the thoracic area and prevent his head from striking the surface of the water slide and to prevent the user from sliding off the board in a forward direction. A recessed portion is located adjacent the bulging chamber to provide an area in which the user may rest his chin.

Beneath and perpendicular to the bulging chamber are a plurality of panels having a somewhat frusto-triangular perimeter which minimizes interference with the leg movements of the user. The outside panels are larger in diameter than the inner panels which form a concave-shaped space to keep a user's body from sliding laterally off the board. Also, the outside panels are adapted to rotate inwardly around the user's body to help prevent the user from laterally sliding off the body board. Between the outside panels and at the bottom of the body board, a concave cut-away provides space for the leg movements of the user. The shape and size of the present invention makes it especially useful for younger children who may have not developed their full coordination.

The features of this body board are most appreciated by the user during the user's approach to the water slide and during landing and impact on the water slide. Typically, the user holds the body board to one side during his approach to the water slide. The combination of the board's frusto-triangular perimeter and the concave cut-away makes it easier for the user to run while holding the body board by significantly reducing, if not eliminating, interference with the user's legs. As the user prepares to position himself on the body board and land on the water slide, he positions the body board in front of his body. The frusto-triangular perimeter of the body board, the inwardly rotating outside panels and the bulging, expanded chamber toward the head of the board combine to cushion the user and prevent him from sliding laterally and forward off the board.

The above and other objects and advantages of the invention will become apparent from the following detailed description of a preferred embodiment, with reference to the accompanying drawings, wherein.

DETAILED DESCRIPTION OF THE INVENTION

Figure 1:
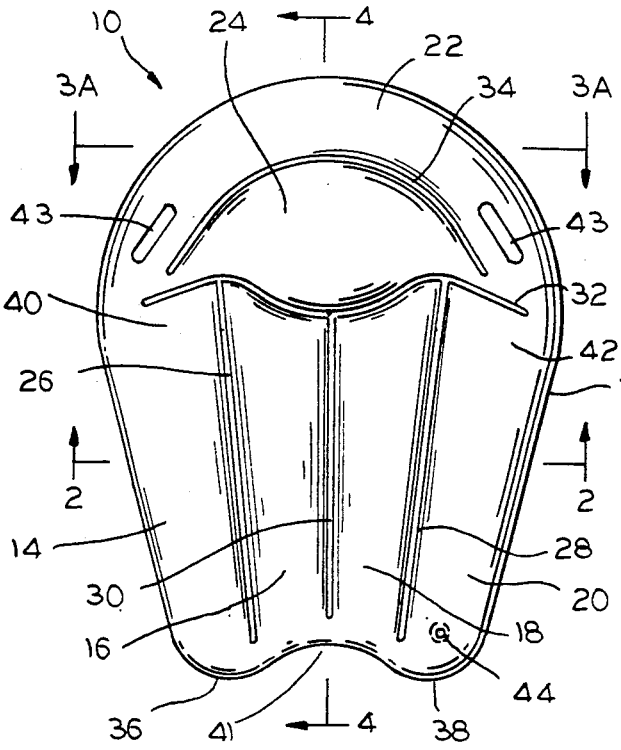
FIG. 1 is a top plan view of the inventive device shown in an inflated condition.

FIG. 1 shows body board 10 having a generally elongated frusto-triangular body 12 that comprises a plurality of interconnected portions or chambers 14, 16, 18, 20, 22 and 24. The body board is generally constructed by two sheets of polyvinyl plastic in face to face contact with heat welded seams which divide it into inflatable compartments. The thermal welding forms a series of grooves or hinge means 26, 28, 30, 32 and 34 which separate and define the interconnected portions or chambers (hereinafter generally referred to as chambers). All the chambers communicate so that they inflate as a unit.

Figure 2:
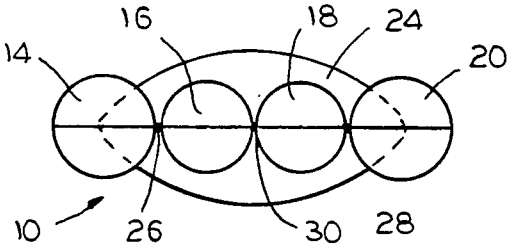
FIG. 2 is a cross-sectional view taken along lines 2—2 of FIG. 1.

The chambers are generally tubular in cross section and have a symmetry about a center line corresponding to section line 4—4 (FIG. 1). Thus, outside panels or chambers 14 and 20 and inner panels or chambers 16 and 18 are mirror images of each other. Outside panels 14, 20 are larger in diameter than inner chambers 16, 18 and together all of the panels 14, 16, 18, 20 form a concave-shaped area to receive a user's body and help prevent the user from sliding laterally off the board. Body 12 has a somewhat frusto-triangular perimeter so that the lower end of sections 14, 20, 36, 38 is smaller than the upper end of the sections. Thus, the outside panels 14, 20 are naturally inclined slightly toward each other (See FIG. 2). A generally semi-circular, concave configuration 41 is located between end sections 36 and 38 of the side panels 14, 20 (See FIG. 1). Shaping the board in this manner makes it less cumbersome to use than prior art boards and reduces interference with the leg movements of the user.

Figure 3:
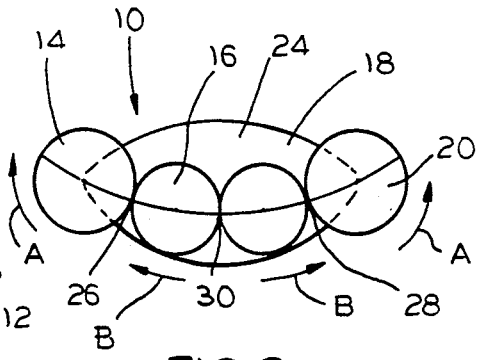
FIG. 3 is a similar cross-sectional view illustrating how there is a rotational movement of the air-inflated side panel chambers around the users body.

Application of pressure caused by the weight of the user's body acting on body board 10 causes side panels 14, 20 to elevate upwardly and rotate inwardly toward one another along hinge lines 26, 28, respectively, as is illustrated by arrows A in FIG. 3. Likewise, the same application of pressure causes inner chambers 16, 18 to rotate inwardly along hinge line 30, as illustrated by arrows B in FIG. 3. Thus, the body board flexes around the user to conform to the user's body and prevent the user from laterally sliding off the body board.

Figure 3A:
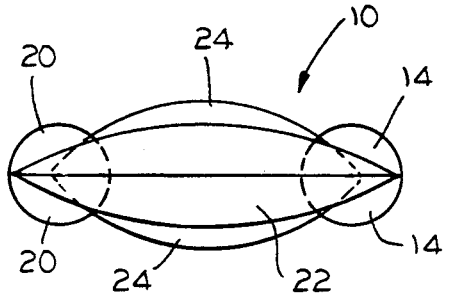
FIG. 3A is another cross-sectional view taken along lines 3A—3A of FIG. 1.
Figure 4:
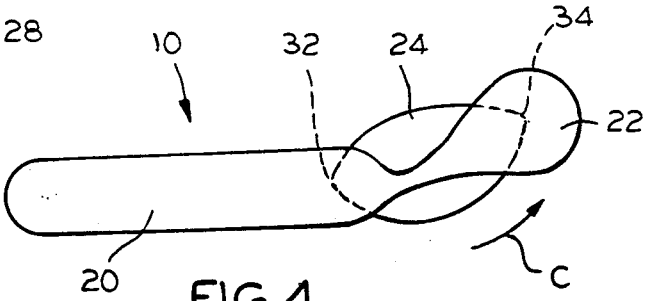
FIG. 4 is a cross-sectional view taken along lines 4—4 of FIG. 1.

Body board 10 (FIG. 1) further includes a pillow-like, bulging, and convex expanded chamber 24 which extends transversely across body board 10 perpendicular to panels 14, 20 and 16, 18 (see FIG. 3A). Chamber 24 cushions the thoracic area of the user and helps to prevent the user from sliding forward off the board. A heat weld forms hinge means 32 which separates bulging chamber 24 from chambers 14, 16, 18, 20 and which enables chamber 24 to pivot and rotate upwardly, as illustrated by arrow C in FIG. 4. Adjacent bulging chamber 24 is a heat weld which forms hinge means 34 and which enables end chamber 22 to also pivot upwardly and inwardly toward bulging chamber 24. The area adjacent hinge means 34 serves as a chin support.

A pair of laterally opposed external handles 43, 43 are optionally located in end chamber 22 and immediately adjacent bulging chamber 24 (See FIG. 1). Handles 43, 43 provide the user with a means to grasp the body board and to help move bulging chamber 24 and end chamber 22 toward the user. Handles 43, 43 are optional and may be eliminated if end chamber 22 can be gripped.

A valve 44 (See FIG. 1) is used to inflate body board 10 with air and preferably is located in an out-of-the-way location, as on its underside, for example.

Figure 5:
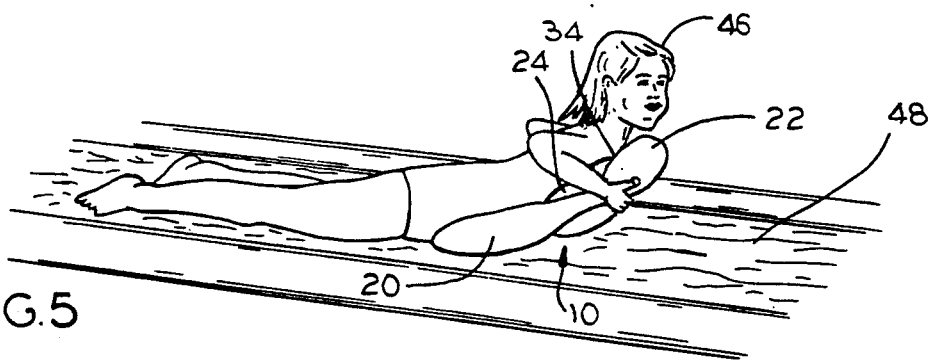
FIG. 5 is a perspective view of a human body on the inventive body board, illustrating its use on a water slide.

FIG. 5 illustrates a use of the body board and the manner in which a user 46 grasps the body board while sliding on a water-covered water slide 48. As FIG. 5 shows, the user's thoracic area is supported by bulging or expanded chamber 24. Should the user's head fall toward the body board, the user's chin would be protected by the portion of the board which is between bulging chamber 24 and end chamber 22. Outside panels 18, 20 are upwardly inclined toward the user in order to help prevent lateral movement of the user on the body board and to protect the user from scrapes.

The body board 10 may be constructed of any sort of material, such as polyvinyl or other suitable elastomers. More particularly, the materials should be able to withstand heat sealing. The chambers in the body board are formed by heat-sealing the body board along the perimeter and along the grooves or hinge means. The top and bottom of the body board are substantially the same.

Body board 10 has not been described in terms of approximate measurements. However, it should be understood that the size of the body board 10 may vary according to needs and the user's body size.

Therefore, it should be recognized that, while the invention has been described in relation to a preferred embodiment thereof, those skilled in the art may develop a wide variation of structural details without departing from the principles of the invention. Accordingly, the appended claims are to be construed to cover all equivalents falling with the true scope and spirit of the invention.

The invention claimed is:

1. An elongated body board for use with a water slide, said body board comprising an inflatable member having a first transverse shock absorbing member at a front of said body board for providing regions to be held by a person holding and riding on said body board and for stopping forward motion of said body board if said body board strikes an obstacle, a second enlarged transverse pillow member for raising the thorax of the body of said person, said first member having a first cross-section and said second member having a second cross-section, said second cross-section being substantially larger than said first cross-section, said shock absorbing and said pillow members protecting the chin and body of said person holding said body board when said person lands on a water slide, said second pillow member tending to prevent forward movement of the person's body during impact when said person and body board land on said water slide, and a plurality of elongated substantially parallel tubes extending perpendicularly to said transverse pillow member along a length of said elongated body board, said elongated parallel tubes comprising two outside tubes of relatively large diameter and at least one inside tube of relatively small diameter whereby said large and small diameter tubes tend to wrap said body board around a lower than thorax part of a body of said person, said members and tubes being in common fluid communication.

2. The body board of claim 1 wherein said regions to be held by said person comprises inflatable handles built into said shock absorbing member.

3. The body board of claim 1 wherein said transverse shock absorbing member and said transverse pillow member have lengths which are greater than an overall width of said parallel tubes to provide protection for the front of said body board.

4. The body board of claim 1 wherein the perimeter of said plurality of elongated tubes is frusto-conical in shape.

5. The body board of claim 4 wherein one end of said plurality of elongated tubes opposite said front of said body board is concave in shape.

6. The body board of claim 1 wherein said transverse members are connected to said plurality of elongated tubes by a means for enabling the transverse members to pivot with respect to said elongated tubes.

7. An elongated body board for use with a water slide, said body board comprising an inflatable member having a first shock absorbing member at a front of said body board for stopping forward motion of said body board if said body board strikes an obstacle, a second enlarged transverse pillow member for raising the thorax of the body of a person riding on the body board, said first member having a first cross-section and said second member having a second cross-section, said shock absorbing and said pillow member cushioning the chin and the body of said person and tending to prevent forward movement of the person's body during an impact when said person and body board land on said water slide, and a plurality of inflatable elongated parallel chambers extending perpendicularly to said second transverse pillow member along a length of said body board, said elongated tubes comprising two outside chambers of a third cross-section and at least one inside chamber of a fourth cross-section, said third cross-section being larger than said fourth cross-section.

8. The body board of claim 7 wherein said first and second members and said plurality of elongated chambers are in common fluid communication.

9. The body board of claim 7 wherein the perimeter of said elongated chambers is frusto-conical in shape.

10. An elongated body board for use with a water slide, said body board comprising a first inflatable member at the front of said body board having an enlarged pillow member with a convex upper surface for raising the thorax of the body of a person riding on said body board, said pillow member having a first cross-section and cushioning the chin and body of said person riding on the body board during impact when said person lands on the water slide, said first cross section being large enough to prevent forward movement of the person's body during impact when the person and body board land on said water slide, and a second elongated inflatable member extending perpendicularly to said first inflatable member along a length of said elongated body board, said second inflatable member having a second cross-section, said first cross-section being larger than said second cross-section.

11. The body board of claim 10 wherein the perimeter of said second inflatable member is frusto-conical in shape.

12. The body board of claim 10 wherein one end of the second inflatable member opposite said first member is concave in shape.

13. The body board of claim 1 wherein said first and second inflatable members are in common fluid communication.

* * * * *